US005299402A

United States Patent [19]

Lee

[11] Patent Number: 5,299,402

[45] Date of Patent: Apr. 5, 1994

[54] STRUCTURES OF FLOORBOARD

[76] Inventor: Cheng-Tsung Lee, No. 360-15, Sec. 3, Fuhsing Rd., Taichung, Taiwan

[21] Appl. No.: 978,321

[22] Filed: Nov. 18, 1992

[51] Int. Cl.[5] ..... E04F 15/18

[52] U.S. Cl. ..... 52/480; 52/384; 52/511

[58] Field of Search ..... 52/480, 385, 384, 510, 52/511

[56] References Cited

U.S. PATENT DOCUMENTS 3,518,800 7/1970 Tank ..... 52/480

4,838,000 6/1989 Ljungkvist ..... 52/480 X 5,016,413 5/1991 Counihan ..... 52/480 X

*Primary Examiner*—Philip C. Kannan

[57] ABSTRACT

The improved structures of floorboard include a groove located in the underside of the floorboard, and a fixing block having a flange dimensioned to fit into the groove of the floorboard. The fixing block has a bottom portion intended to anchor in the cement foundation. The fixing block can be made to join with an elastic floor frame fastened to the cement floor. The floorboard can be conveniently and economically fastened to the cement foundation in various forms by means of the fixing block which is detachably fastened to the floorboard.

8 Claims, 8 Drawing Sheets

STRUCTURES OF FLOORBOARD

BACKGROUND OF THE INVENTION

The present invention relates to a floorboard, and more particularly to a floorboard so designed as to facilitate quick installation and easy fitting of such floorboard.

The current trend of interior decoration is such that the old-fashioned indoor floors, such as a cement floor, a plastic floor, a ceramic floor and so forth, are gradually replaced by a high-quality and handsome wood floor or wooden floor. Accordingly, the methods used to furnish the floor have been so improved as to meet the requirements of the modern construction technology. The current methods of furnishing the floor include: 1. the floorboards are adhered to the ground directly; 2. the ground is furnished with the corner boards onto which the floorboards are nailed; 3. the ground is furnished with the corner boards onto which the plywoods are nailed before the floorboards are finally furnished. Such methods as described above have shortcomings, which are further expounded explicitly hereinafter.

The first method described above is fast and economical. However, the floorboards and the ground are not securely fastened and centered. The adhesive used in this method is subjected to the moisture which is often responsible for the adhesive to lose its adhesion. In addition, the aging adhesive tends to peel off the floorboards having inconsistent coefficients of contraction and expansion.

The second method of employing the corner boards may serve to overcome the shortcomings of the first method described above. However, the second method is defective in that the floorboards must be of appropriate length, and that the cost of furnishing such floor is relatively high, and further that such floor tends to make noise when walked on, and still further that the open space between the floor and the ceiling is made smaller in view of the fact that the floor level is raised by the corner boards onto which the floorboards are nailed.

The third method described above is costly. However, the floorboards of shorter length may be used in this method, because the floorboards are attached to the plywoods which in turn are nailed to the corner boards. In addition, the floor furnished by the third method also tends to make noise when walked on.

SUMMARY OF THE INVENTION

It is therefore, the primary objective of the present invention to provide a floorboard with improved structures, which include a groove constructed under the floorboard and intended to cooperate with a flange of a fixing block having a recess in the middle thereof and a projection disposed thereunder. Such projection can be inserted into the cement floor so as to fasten the floorboards securely to the cement floor. The fixing block may be of any shape as long as it can be inserted securely into the cement floor. The floorboards may be of any length. The floorboards of various sizes and lengths may be used in combination to construct a floor having various patterns. Such floor is easy to construct and is securely fastened to the cement floor.

It is another objective of the present invention to provide a floorboard with a fixing block, which may be constructed in such a manner that it extends horizontally from the center of the floorboard toward both sides of the floorboard. In addition, the fixing block is provided with an arcuate projection having a flat bottom so as to make it possible for the fixing block to be securely anchored in the cement floor or in the elastic floor frame provided with a recess to receive the fixing block. The floorboards can be easily and rapidly installed or replaced.

It is still another objective of the present invention to provide a floorboard, which can be combined with a floor frame fastened to the floor. As a result, there is an open space between the floorboards and the cement floor to which the floor frame is securely fastened. Such open space may be used to accommodate the wires pipes or stuffed with such materials as plastic, polyethylene foam material, etc. Such stuffing materials serve to prevent the floor from making noise when the floor is walked on.

It is still another objective of the present invention to provide a floorboard with an arcuate groove located in each of two sides opposite to each other. As a result, when two of such floorboards are joined together, there is an open space formed therebetween. Such open space serves to accommodate the expansion of the two adjacent floorboards. In addition, the floorboard is provided on the upper surface thereof with an arcuate angle. Therefore, when two such floorboards are joined together, a stip is formed therebetween so as to compensate the deficiency that the foundation floor is not flat. In addition, the portion between the arcuate angle and the lower side of the middle portion is a plan surface, which serves to prevent debris or grout from entering accidentally the middle portion.

It is still another objective of the present invention to provide a floorboard and a floor frame, which are respectively shielded with a contraction membrane made from polyethylene or polyvinyl chloride and intended to serve as an insulating means separating the floorboard or the floor frame from the cement foundation. The contraction membrane may be cut to allow the fixing block to expose in order to be fastened to the floor frame.

It is still another objective of the present invention to provide a floorboard with a thin plate, which extends beyond the edge of the floorboard to an extent that is reaches beyond the edge of an adjacent floorboard or that it reaches the wall of the room. Such thin plate is intended to prevent the mortar from escaping through the narrow opening.

It is still another objective of the present invention to provide a method of combining the floorboards, which is also applicable to combining the wallboards. The back of the frame is coated with glue and is then fastened to the wall. The frame may be also embedded in the cement wall. The fixing block of the wallboard is then fastened to the frame attached securely to the wall.

The foregoing objectives, structures and functions will be better understood by studying the following detailed description of a preferred embodiment of the present invention in conjunction with the drawings provided herewith.

DETAILED DESCRIPTION OF THE PREFERRED EMBODIMENT

Figure 1A:
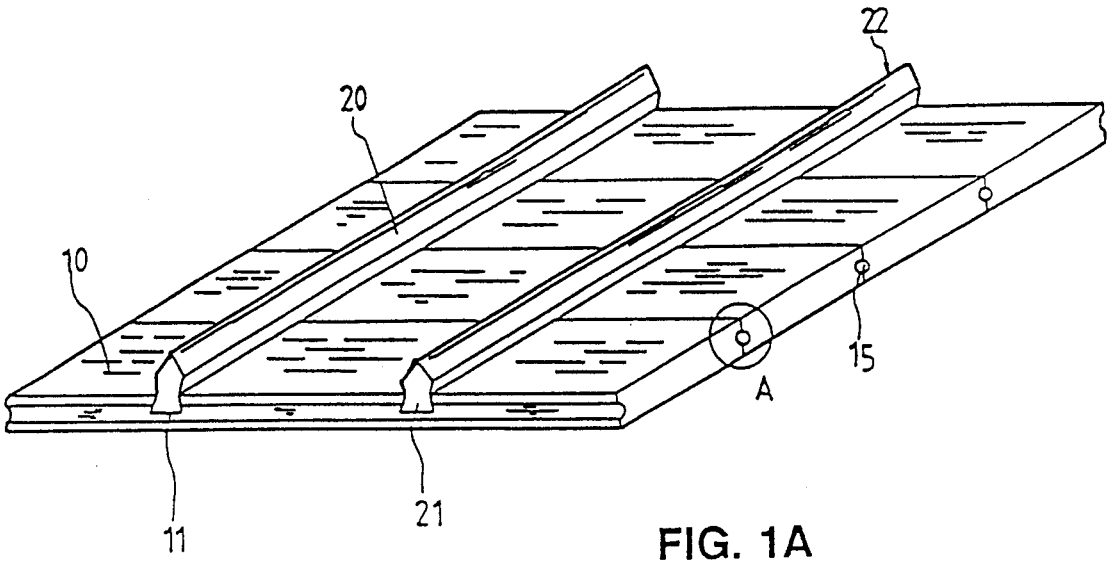
FIG. 1A shows an assembled floor board with fixing block.
Figure 1B:
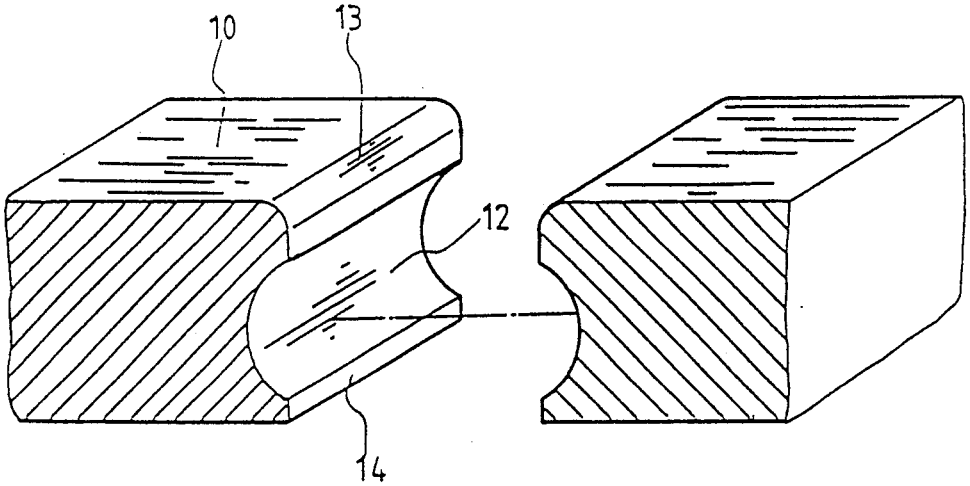
FIG. 1B shows how two floor boards are being joined together.
Figure 2:
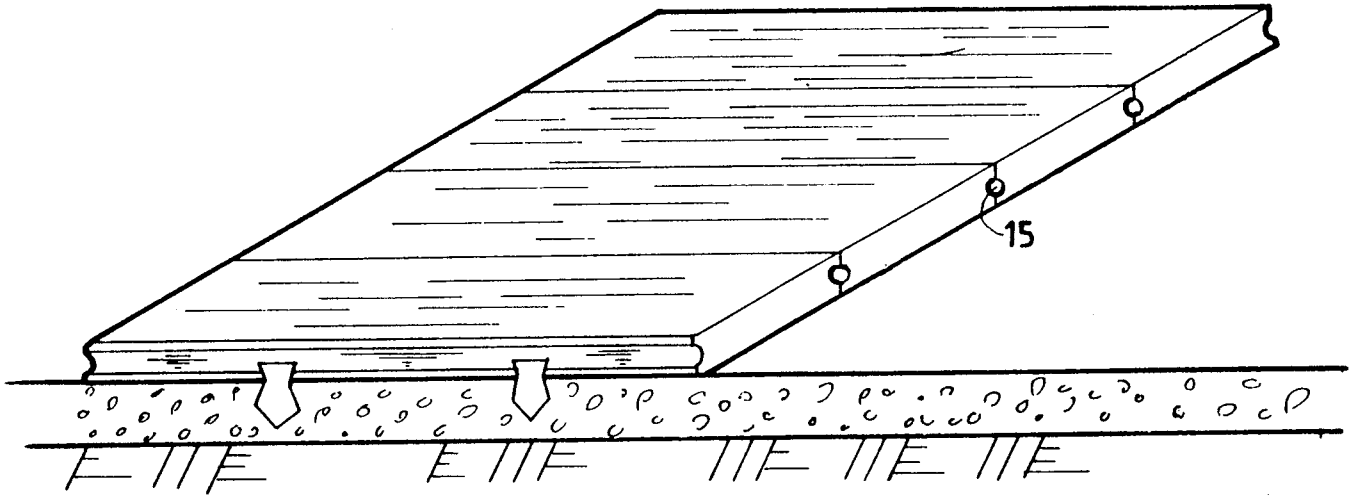
FIG. 2 shows the floorboards of the present invention assembled above a concrete slab.

Referring to FIGS. 1A, 1B and 2, a floorboard 10 embodied in the present invention is shown to comprise a groove 11 in conjunction with a fixing block 20 having a flange 21 disposed thereon. In addition, the fixing block 20 comprises a tapered portion 22 and an arcuate groove 12 located in the lateral side of the floorboard 10. Therefore, when two floorboards 10 are joined together, their arcuate grooves 12 join to form an open space 15 intended to accommodate the expansion of the floorboards 12 which may be brought about by a climatic factor. Instead of other forms of groove, the arcuate groove 12 is used, because the thickness of the floorboard ranges between 1.2 and 2.1 centimeters. In other words, the load capacity of the floorboard 12 is not greatly compromised by the arcuate groove 12. Furthermore, the floorboard 10 is provided with an arcuate edge 13. As a result, a stip is formed by the two arcuate edges 13 adjacent to each other when two floorboards 10 are joined together. Located at a position opposite to the arcuate edge 13 is a flat surface 14. When two floorboards 10 are joined together, two adjacent flat surfaces 14 meet to seal off the open space 15 so as to prevent the mortar from entering the open space 15.

The fixing block 20 is fastened to the floorboard 10 in such a manner that the flange 21 of the fixing block 20 is slid into the groove 11 of the floorboard 10. The tapered portion 22 located at the bottom of the fixing block 20 is used to anchor into the cement foundation at the time when the cement foundation is still fresh and wet. As a result, the floorboard 10 is securely attached to the cement foundation. In addition, the floorboard 10 is protected by a contraction membrane 40 preventing the floorboard 10 from making a direct contact with the cement. Therefore, the floorboard 10 is immune from corrosive actions brought about by water and alkaline materials, so as to prolong the service life of the floorboard 10.

Figure 3:
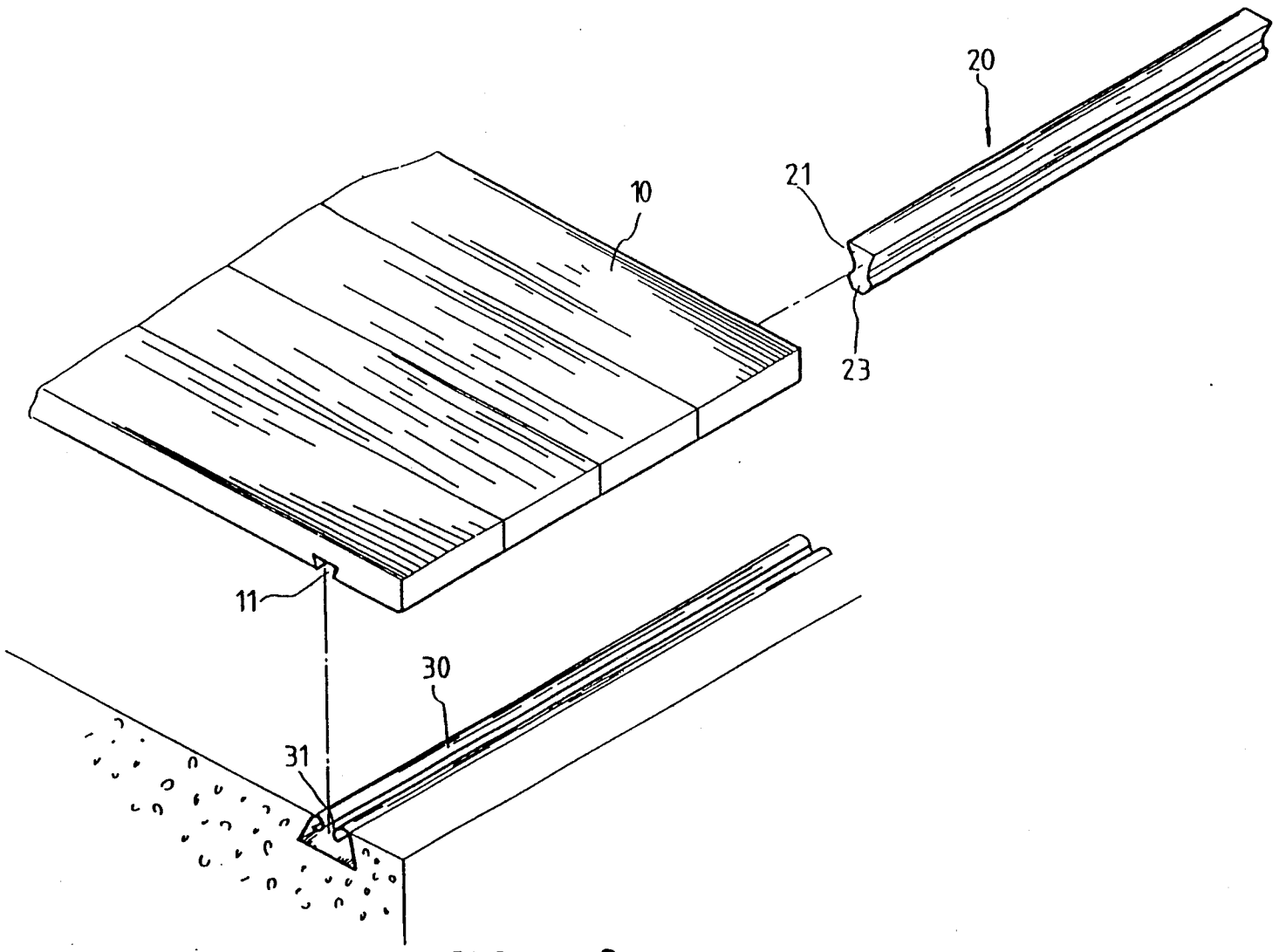
FIG. 3 shows an exploded view of the floorboard, fixing block and floor frame.

Now referring to FIG. 3, the fixing block 20 is shown comprising a projection 23 which bevels inwards toward the flat bottom of the fixing block 20. The projection 23 is so dimensioned as to fit securely into a furrow of an elastic floor frame 30, with the furrow having a flat bottom and beveling gradually toward the top portion thereof. The floor frame 30 has an open end 31 smaller than the outer diameter of the projection 23. As a result, the fixing block 20 can be securely retained by the floor frame 30 which is securely embedded in the cement foundation.

Figure 4A:
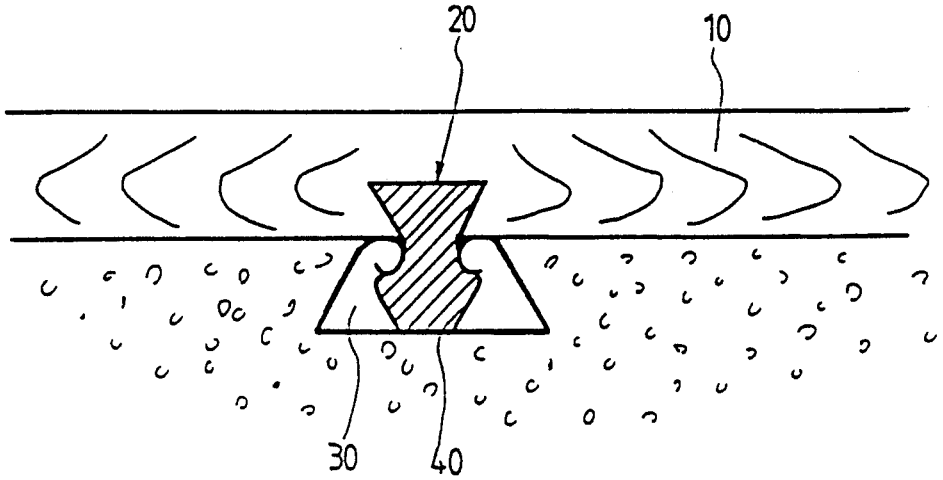
FIGS. 4A and 4B show a cross-sectional view of the present invention mounted above a concrete slab.
Figure 4B:
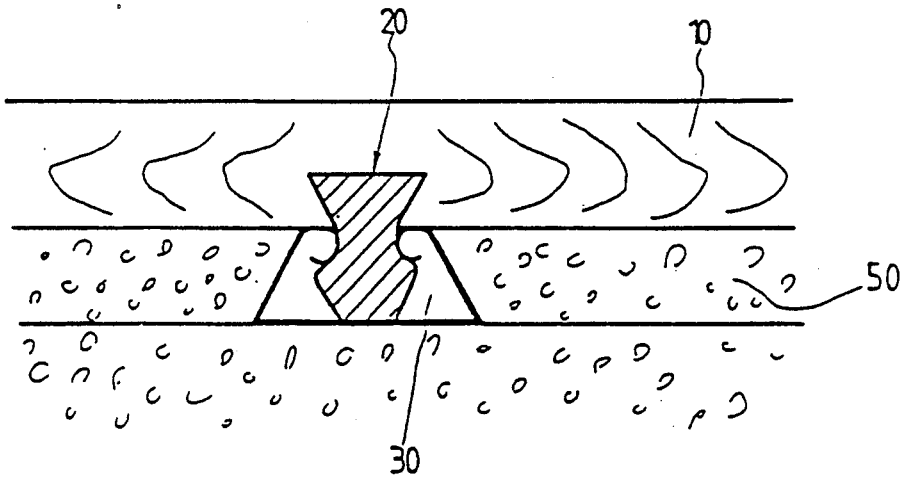

As shown in FIG. 4A, the floor frame 30 is shielded with a contraction membrane 40, which may be in the form of a plastic sheet located between the floor frame 30 and the cement. The floor frames 30 are properly positioned before they are welded to the iron bars. The fresh mortar is then filled in the space located between the two floor frames 30. Subsequently, the contraction membrane 40 of the floor frame 30 is cut, so as to permit the projection 23 of the fixing block 20 of the floorboard 10 to be retained by the floor frame 30. As a result, the floorboard 10 and the floor frame 30 are united securely, as shown in FIG. 1. The floor frame 30 covered with the contraction membrane 40 can be precisely positioned and leveled on the cement foundation before an additional smearing work is done. The top surface of the floor frame 30 must be kept in alignment with the smearing surface 50, as shown in FIG. 4. The contraction membrane 40 serves to prevent the cement from entering the interior of the floor frame 30. The floorboard 10 is made to join with the the fixing block 20 by means of the groove 11 so dimensioned as to permit the flange 21 of the fixing block 20 to slide thereinto. As the furnishing of the floorboard 10 is completed, the contraction membrane 40 can be cut to allow the projection 23 of the fixing block 20 to be exposed so as to be retained by the floor frame 30. As a result, the floorboard 10 is securely attached to the cement foundation, as shown in FIG. 4-2.

Figure 5:
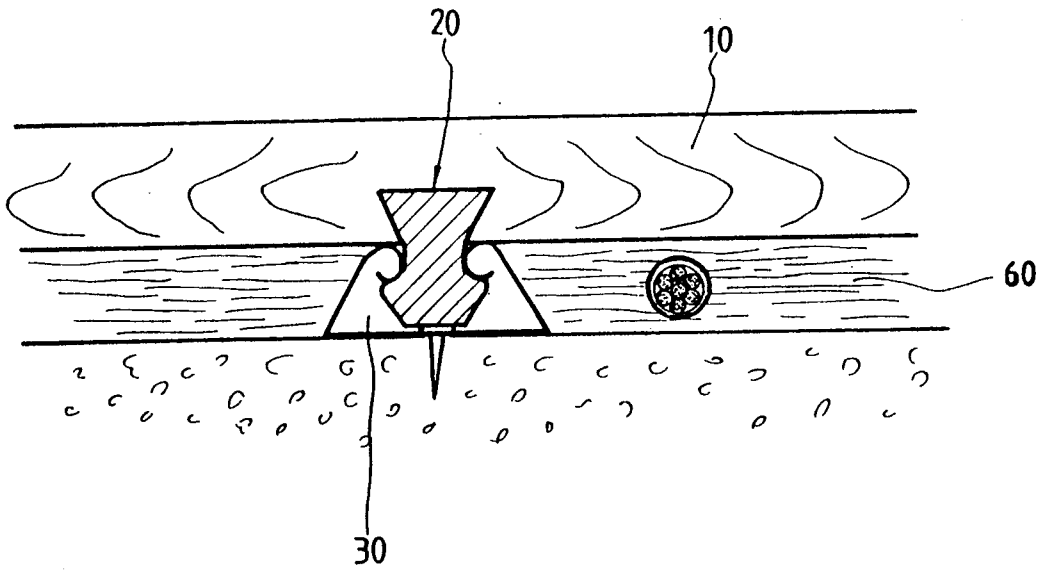
FIG. 5 shows a cross-sectional view of the present invention illustrating the use of stuffing material.

The floor frames 30, which are properly positioned and leveled on the cement foundation, can be fastened to the cement foundation by means of the nailing gun. Thereafter, the floor frames 30 by inserting the projections 23 of the fixing blocks 20 into the floor frames 30. The clearance located between the floorboards 10 and the cement foundation may be used to accommodate the pipes 61 or filled with the stuffing substances 60, such as plastic material, polyethylene foam material, etc., as shown in FIG. 5. The stuffing substances serve to avert the generation of noise and to eliminate the necessity of doing additional work of smearing.

Figure 6:
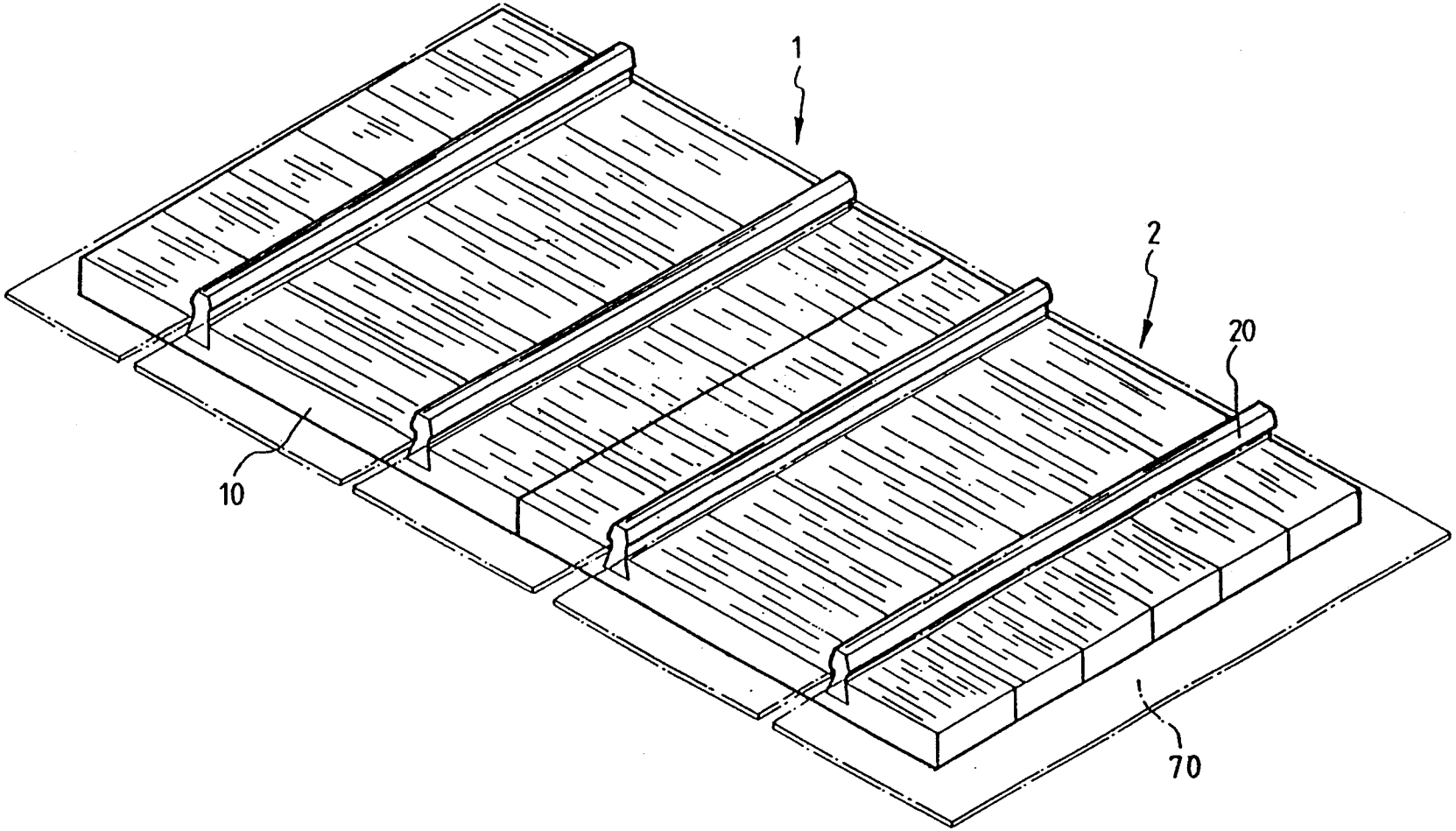
FIG. 6 shows the present invention assembled in use with a thin plate.

As shown in FIG. 6, before two floorboards 1 and 2 are joined together, a thin plate 70 is attached to the underside of each of the two floorboards 1 and 2 in such a manner that the thin plate 70 extends beyond the edge of the floorboard 1 into the underside of the floorboard 2, so as to prevent the mortar from being squeezed out through the mortar from being squeezed out through the gap located between the two floorboards 1 and 2. If the edge of the thin plate 70 attached to the underside of the floorboard 1 or 2 meets the wall, the edge of the thin plate 70 must be cut to form into line with the wall surface.

Figure 7A:
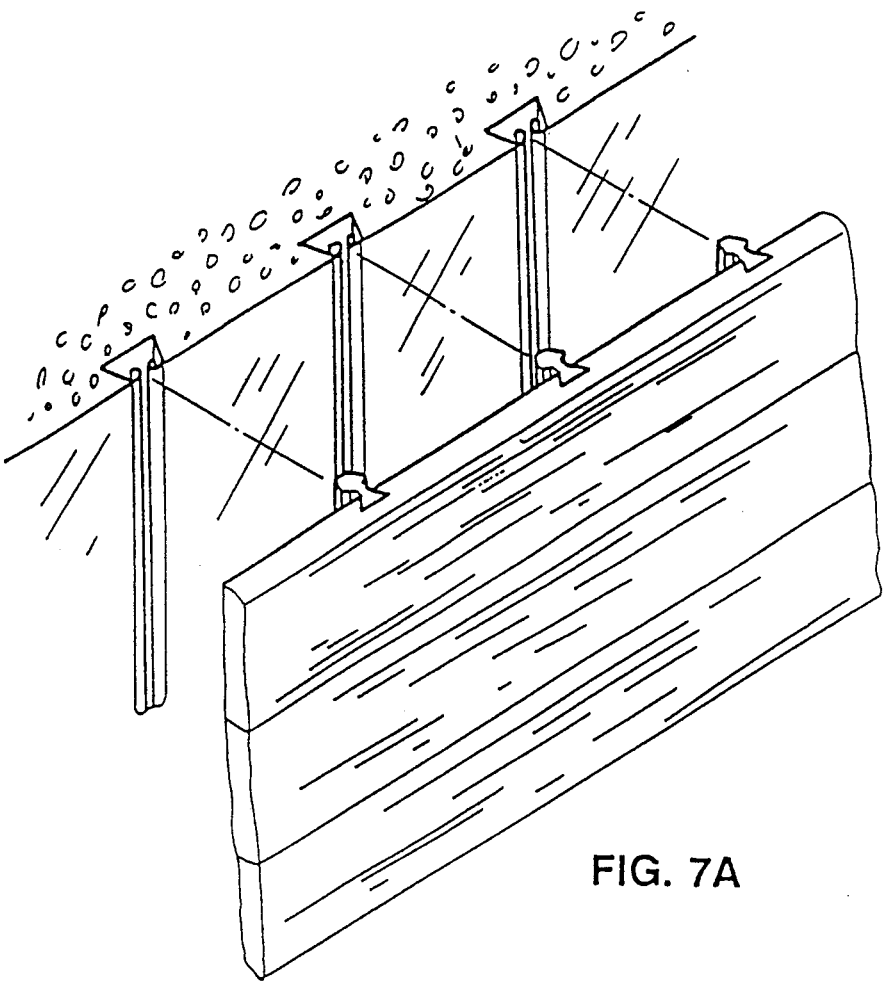
FIG. 7A shows another embodiment of the invention as applied to wall boards.
Figure 7B:
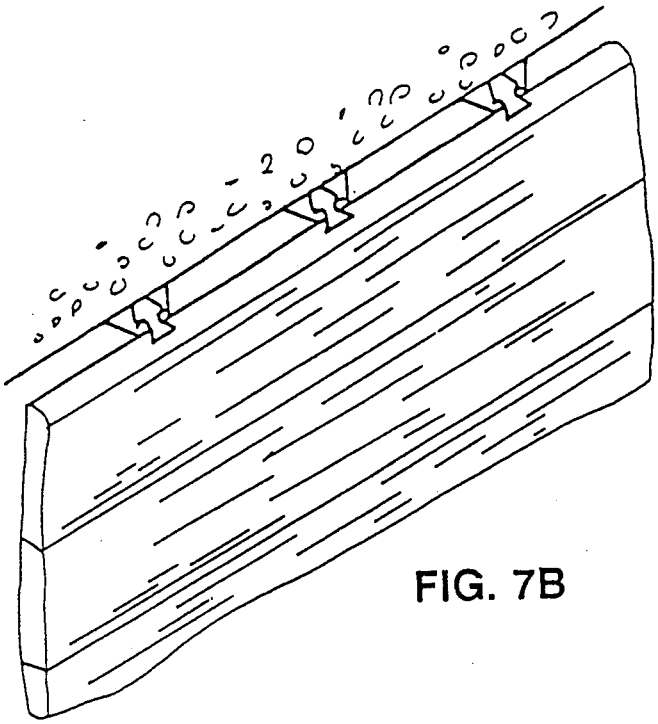
FIG. 7B shows how the wall boards of FIG. 7A are affixed to the wall.
Figure 8A:
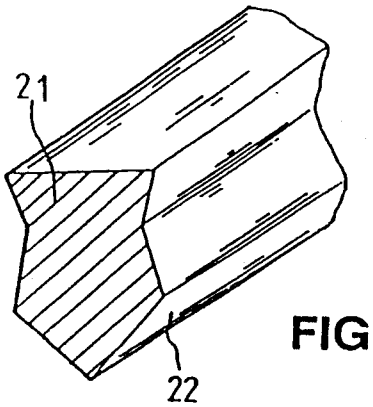
FIG. 8A shows fixing blocks of a preferred design shape.
Figure 8D:
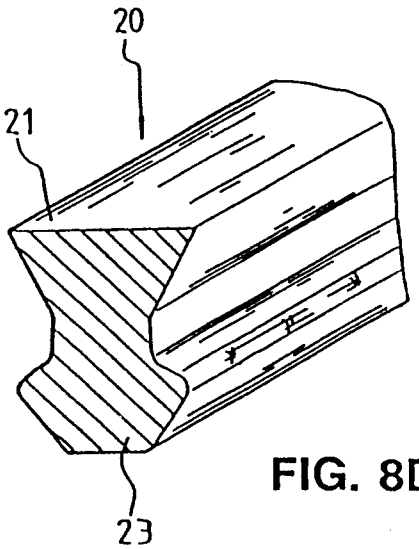
FIG. 8D shows fixing blocks of yet another preferred design shape.
Figure 8B:
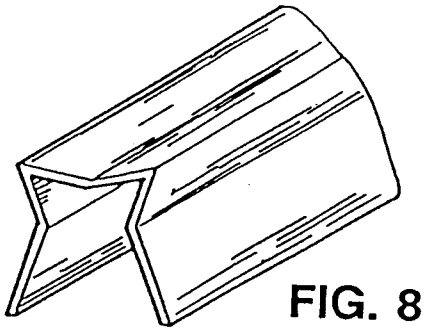
FIG. 8B shows fixing blocks of another preferred design shape.
Figure 8E:
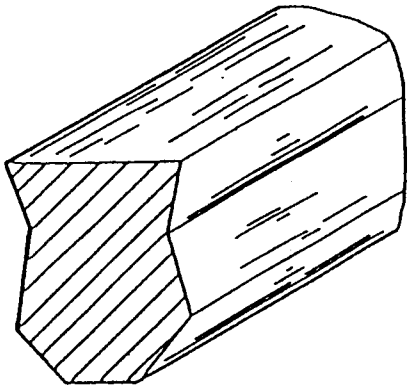
FIG. 8E shows fixing blocks of yet another preferred design shape.
Figure 8C:
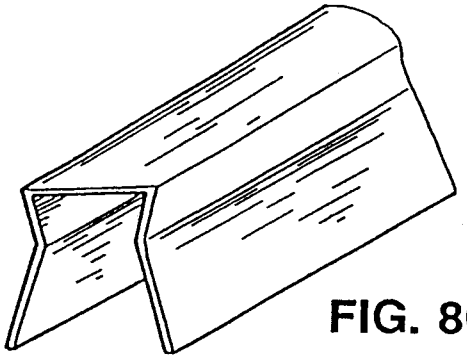
FIG. 8C shows fixing blocks of yet another preferred design shape.
Figure 8F:
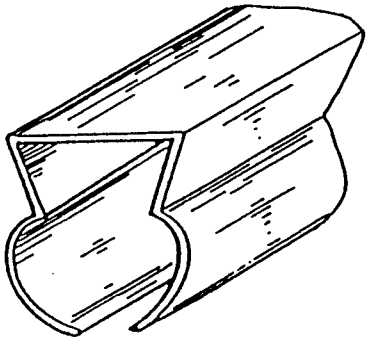
FIG. 8F shows fixing blocks of yet another preferred design shape.

The frunishing patterns of the floorboards described above are applicable to the wallboards, which may be prefabricated at the factory and shipped to a place where they are to be used. The floor frame 30 used in the present invention may be used in the wall furnishing. The underside of the floor frame 30 is coated with an adhesive agent before the floor frame 30 is fastened to the wall surface by means of a nailing gun. The floor frame 30 may be embedded in the plaster wall before a prefabricated floorboard 10 is fastened to the floor frame 30 by means of the fixing block 20. As shown in FIGS. 7A and 7B.

As shown in FIGS. 8A through 8F, the fixing blocks 20 embodied in the present invention may be of various shapes. The fixing block 20 comprises a flange 21 extending horizontally from both sides of the upper portion thereof, with the middle portion of the fixing block being of recess having a plan bottom fromed by the wall beveling outwards. The portion between the flange 21 and the mid-portion of the fixing block 20 may be concave so as to form an arcuate frame body.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the hereinafter appended claims.

What is claimed is:

1. An improved floorboard structure comprising a floorboard and a fixing block, said floorboard having a groove located in underside thereof, said groove having a predetermined size and shape, and said fixing block having a flange with a size and a shape which are corresponding to the size and shape of said groove so as to allow said flange to be inserted into said groove, said fixing block further having a tapered portion by which said fixing block can be securely anchored in a cement foundation.

2. The improved floorboard structure of claim 1 wherein said floorboard is provided respectively at front side thereof and rear side thereof with an arcuate groove, which forms an open space in conjunction with an arcuate groove of another floorboard adjacent to said floorboard, with said arcuate groove having an arcuate wall and plane upper and lower sides.

3. The improved floorboard structure of claim 1 wherein said fixing block comprises an arcuate projection and a flat bottom, with said arcuate projection so dimensioned as to fit into a floor frame embedded in said cement foundation.

4. The improved floorboard of claim 3 wherein said floorboard and said floor frame are protected by a contraction membrane made from polyethylene or polyvinyl chloride, where said contraction membrane is disposed between said floor frame and said cement foundation.

5. The improved floorboard structure of claim 1 wherein said floorboard is protected by a contraction membrane made from polyethylene or polyvinyl chloride, said contraction membrane disposed between said floorboard and said cement foundation.

6. The improved floorboard structure of claim 1 wherein said floorboard is provided with a thin plate attached to underside thereof in such manners that it extends beyond the edge of said floorboard into underside of another floorboard adjacent to said floorboard, and that it is cut to form into line with a wall surface of a room which is furnished with said floorboard.

7. The improved floorboard structure of claim 1 wherein said fixing block is of various shapes and provided with a flange extending horizontally from both sides of upper portion thereof and with a concave middle portion having a plane bottom formed by a wall beveling outward.

8. The improved floorboard structure of claim 1 wherein said floorboard and said cement foundation form an open space, which is filled with a stuffing substance.

* * * * *